United States Patent [19]

Collette

[11] Patent Number: 4,798,533

[45] Date of Patent: Jan. 17, 1989

[54] ASPHALT RECYCLING CONVEYOR

[76] Inventor: Jerry R. Collette, P.O. Box 1482, Englewood, Fla. 34295-1482

[21] Appl. No.: 202,453

[22] Filed: Jun. 6, 1988

[51] Int. Cl.[4] ..... F27D 3/00

[52] U.S. Cl. ..... 432/227; 432/229; 432/239

[58] Field of Search ..... 432/239, 227, 229; 110/110, 224, 255, 276

[56] References Cited

U.S. PATENT DOCUMENTS

| | | | |
|---|---|---|---|
| 4,010,552 | 3/1977 | Peterson | 432/128 |
| 4,256,453 | 3/1981 | Csapo | 432/239 |
| 4,399,906 | 8/1983 | Millsap | 110/110 |
| 4,430,949 | 2/1984 | Ekenberg | 110/224 |
| 4,628,828 | 12/1986 | Holtham et al. | 110/255 |
| 4,631,026 | 12/1986 | McKinney | 432/239 |
| 4,669,396 | 6/1987 | Resh | 110/110 |

*Primary Examiner*—Henry C. Yuen

*Attorney, Agent, or Firm*—Charles J. Prescott; Raymond H. Quist

[57] ABSTRACT

An asphalt recycling conveyor system has a substantially horizontal collecting trough for receiving returned, unused hot mix asphalt. Deflecting plates are provided at the back and ends of this trough, and spaced guard rails extend across it. Asphalt is moved in the trough by an auger having standard pitch to a hopper at one end of the trough. Asphalt lump breaking rods extend from the auger shaft above the hopper to prevent these lumps from bridging the hopper opening. An elevating trough may receive the asphalt from the collection trough hopper and carry it to a higher elevation. The elevating trough has an auger having one-half standard pitch and is turned at a faster speed than the collection trough auger. Heat trace lines are provided on the bottom of the troughs to prevent asphalt buildup.

11 Claims, 2 Drawing Sheets

ASPHALT RECYCLING CONVEYOR

BACKGROUND OF THE INVENTION

1. Field of the Invention

This invention relates generally to conveyors, and more particularly to a conveyor arrangement for recycling partially cooled asphalt.

2. Description of Related Art

Asphalt which has been prepared for paving is loaded from a silo into a dump truck which carries the asphalt to the location where it is to be used. This asphalt is at a temperature of between 300° and 320° F. The asphalt is dumped into a paving machine which spreads a layer of desired thickness.

Unplanned interruptions in the paving work because of rain, equipment breakdowns, etc. result in one or more truckloads of asphalt which cannot be unloaded into the paving machine and which is ordinarily returned to the asphalt plant and dumped on the ground before it hardens in the truck. This asphalt is now generally between 250° and 280° F.

A need exists, consequently, for apparatus to appropriately treat and return this unused hot mix asphalt to the silo for subsequent use.

U.S. Pat. No. 4,136,964, Swisher, Jr., entitled: "Apparatus for Simultaneously Mixing and Conveying Particulate Material", discloses a conveyor having a plurality of lifting surfaces forming a continuous belt. The conveyor also mixes aggregate with the asphalt solution to form hot mix asphalt and is provided with heating devices.

U.S. Pat. No. 4,458,847, Petersen, entitled: "Dosage Granulator for Tearing Up a Material of High Viscosity", discloses a granulator which is intended to granulate returned asphalt of high viscosity.

U.S. Pat. No. 4,483,620, Shinohara et al., entitled: "Regenerative Heating and Melting Device for Recovered Asphalt Concrete Rubble", discloses apparatus for treating hardened asphalt rubble for reuse.

The foregoing patents do not disclose apparatus for receiving returned asphalt which is at a temperature of from 250 to 280 degrees F. directly from a dump truck and treating it for return to the silo.

It is therefore an object of this invention to provide an asphalt recycling conveyor which reduces the viscosity of returned hot mix asphalt and returns the asphalt for reuse.

It is also an object of this invention to provide an conveyor which will deliver the treated returned asphalt to a silo.

It is another object of this invention to provide an asphalt recycling conveyor which will convert a bulk mass of returned asphalt into a continuous stream.

It is a further object of this invention to provide an asphalt recycling conveyor which will provide protection from injury for personnel operating the system.

In accordance with these and other objects, which will become apparent hereafter, the instant invention will now be described with reference to the accompanying drawings.

SUMMARY OF THE INVENTION

A collecting trough having a semicircular bottom, a front wall, a back wall and end walls is positioned to receive returned or recycled asphalt from a dump truck. The asphalt is between 250° and 280° F. and is highly viscous, but can still be dumped. The collecting trough has spaced guard rails extending across the top. The rails are spaced sufficiently and sized to permit the asphalt to flow through, but are spaced close enough to protect personnel. The back and end walls of the collecting trough have upwardly extending deflecting plates to minimized spillage of the asphalt. An auger in the trough is rotated to move the asphalt to a hopper secured to the bottom of the trough at one end. Heating lines extend the length of the trough in heat transfer relationship with the bottom to prevent further cooling and to lower viscosity. The collecting trough hopper may be positioned to discharge directly into a silo for redistribution, or it may discharge into the lower end of an elevating trough. The elevating trough has a semicircular bottom, longitudinally extending side walls and end walls. A discharge hopper is secured to the bottom of the elevating trough at its upper end. A rotating auger moves the asphalt to the discharge hopper. The elevating trough may include heat lines, and has a cover which may be foraminous.

DETAILED DESCRIPTION OF THE INVENTION

Figure 1:
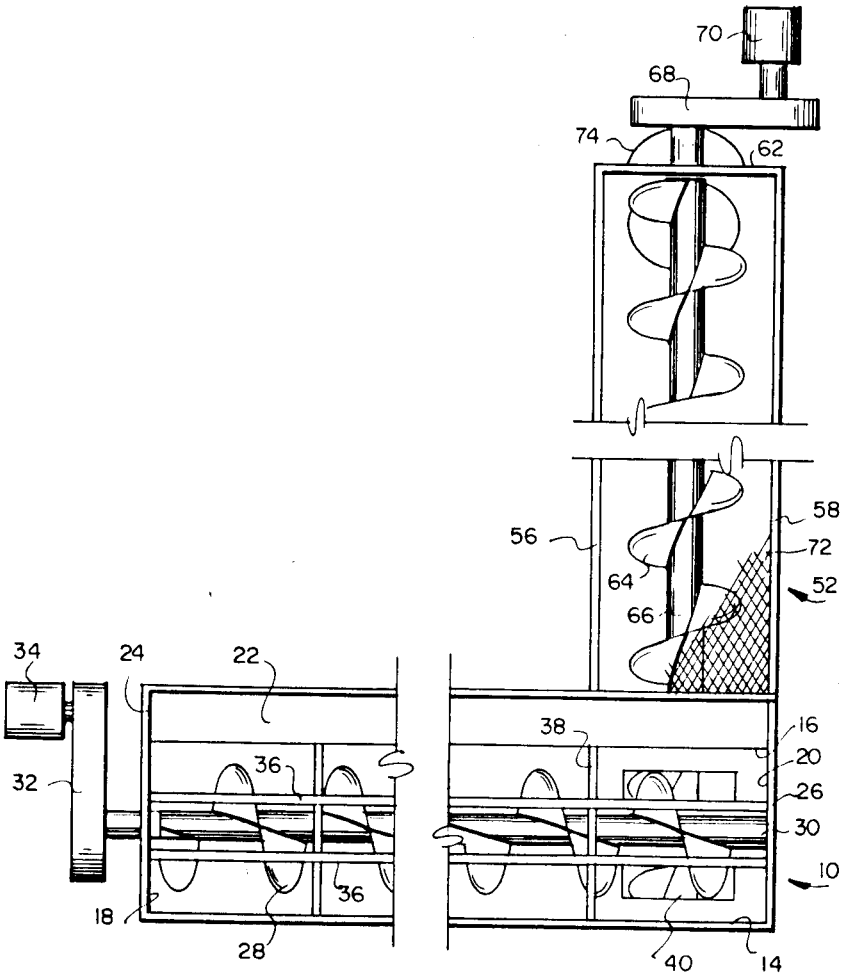
FIG. 1 is a plan view of an asphalt recycling conveyor system in accordance with the invention.
Figure 2:
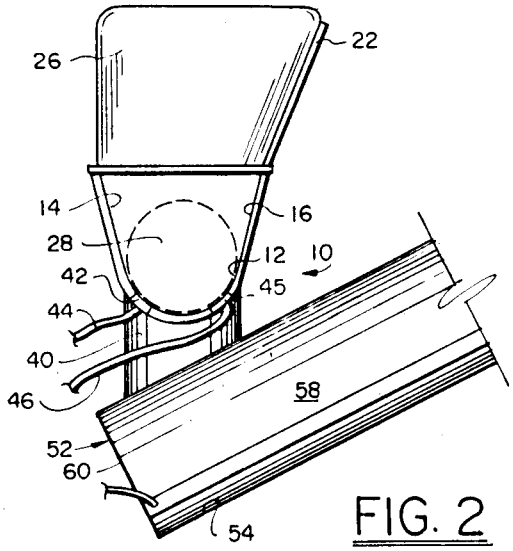
FIG. 2 is a side elevation of a portion of the asphalt recycling conveyor system of FIG. 1.

Referring now to FIGS. 1 and 2, collecting trough 10 has a semicircular bottom 12, front wall 14, back wall 16 and end walls 18 and 20. A back deflecting plate 22 extends upwardly from back wall 16 and end deflecting plates 24 and 26 extend upwardly from end walls 18 and 20 respectively. These deflecting plates assist in directing asphalt which is being deposited into collecting trough 10 from a dump truck so as to eliminate or minimize spilling.

Auger 28 is secured to shaft 30 which is rotatably mounted in end walls 18 and 20. Shaft 30 has a pulley which is rotated by belt 32 which is driven by a pulley connected to motor 34. Laterally extending guard rails 36, and fore and aft extending guard rails 38 cross the top of collecting trough 10. These guard rails are spaced so as to permit the ready passage of asphalt therethrough, while preventing injury to personnel. Auger 28 moves asphalt laterally in collecting trough 10 to hopper 40 which is secured to bottom 12 of collecting trough 10.

Figure 3:
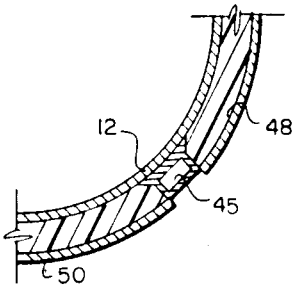
FIG. 3 is a detail in cross-section of a trough used in the recycling conveyor system.

During the time the hot mix asphalt is in the dump truck, it cools relatively slowly because the area exposed to the air is small compared to the mass. This area is increased when the load is dumped, so that it is desirable to make provision for heating the asphalt in the conveyor system. Referring to FIGS. 2 and 3, conveyor bottom 12 is preferably of metal and has at least two heating lines 42 and 44 which extend the length of collecting trough 10. One line, say line 42 carries hot oil supplied by hose 44 from one end of the trough to the other. A cross-over hose (not shown) carries the oil to line 44 which returns it to hose 46 which will carry it for reheating. As more clearly shown in FIG. 3, the heating lines are in good heat transfer relationship with bottom 12. Thermal insulation 48 covers the collecting trough 10 so a to minimize loss of heat, and protective cover 50 protects the insulation. Hot oil heating lines for heating the troughs are preferable for most sites since hot oil is normally available. Electric resistance heating or other heating of the troughs may be substituted in some cases. Some form of trace heating is desirable to prevent excessive buildup of asphalt in the trough which results if the asphalt cools too much.

It will be recognized that hot mix asphalt plants have different equipment layouts. One element in such plants is a silo from which the hot mix asphalt is discharged into the beds of dump trucks. In plants which include a truck ramp extending to the level of the top of the silo, a collecting trough may discharge directly from hopper 40 into the top of the silo. In other plants, it is necessary to elevate the asphalt to reach the top of the silo.

Returning to FIGS. 1 and 2, elevating trough 52 is similar in some respects to collecting trough 10. Elevating trough 52 has a semicircular bottom 54, longitudinally extending side walls 56 and 58 and end walls 60 and 62. Auger 64 is secured to shaft 66 which is rotatably mounted in end walls 60 and 62. Shaft 66 has a pulley which is rotated by belt 68 which is driven by a pulley connected to motor 70. Cover 72, which may be foraminous as shown such as expanded metal, extends across elevating trough 52 except where hopper 40 discharges into it. Collecting trough 10 functions to convert the mass of asphalt dumped into it, into a stream of asphalt which is discharged from hopper 40 into elevating trough 52. Although another type of conveyor can be used to handle this stream of asphalt, an auger type conveyor permits economies because of the similarities to collecting trough 10. Hopper 74, at the upper end of elevating trough 52, is used to discharge the elevated asphalt into the silo or onto another conveyor if desired.

Where an elevating or inclined trough is used in conjunction with a collecting trough, it is important to have flow matching. That is, the collecting trough must not deliver asphalt to the elevating trough at a rate greater than the elevating trough can handle. Collecting trough 10 has been fabricated with a twelve inch diameter auger having a standard pitch of twelve inches. This auger is rotated at fifty two RPM. Elevating trough has a fourteen inch diameter auger having a half pitch of seven inches, and is rotated at one hundred forty seven RPM. These differences accomodate the "fall back" of asphalt in the elevating trough. In addition, it is necessary not to start the collecting trough auger before the elevating trough auger to avoid a blockage.

Figure 4:
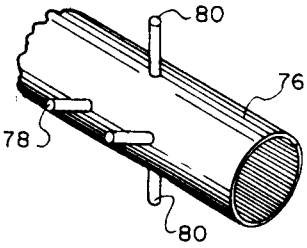
FIG. 4 is a detail of a shaft modification.

FIG. 4 shows a preferred modification of the portion of auger shaft 30 which is positioned above hopper 40. Radially extending rods are spaced about shaft 76 to break lumps of asphalt which are toobig to pass through hopper 40 and would otherwise bridge across the opening. A pair 78 of such rods about four inches apart extend from opposite sides of shaft 76. Intermediately located between these pairs and ninety degrees circumferentially removed, are single rods 80. Rods five inches long and ⅝ths inch diameter have been used with the shaft of the twelve inch auger. Hopper 40 in this embodiment reduces to a twelve by twelve inch orifice.

Figure 5:
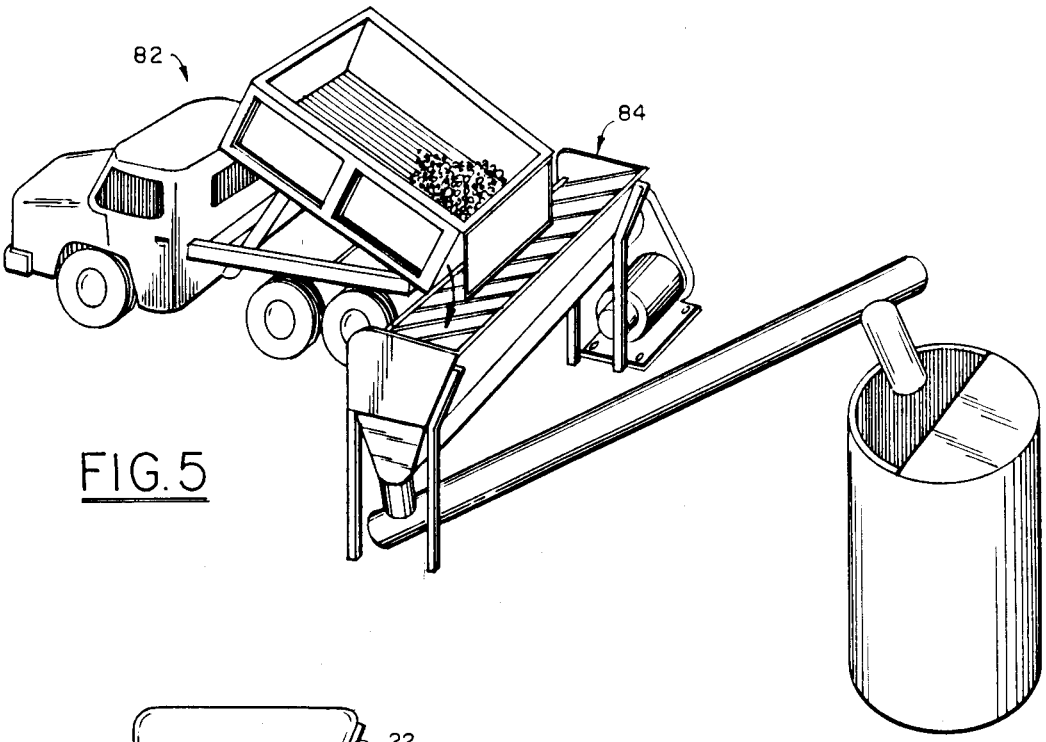
FIG. 5 is a pictorial showing the apparatus of the invention in use.

FIG. 5 shows dump truck 82, in position at collection trough 84, in the process of dumping hot mix asphalt to be recycled.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. An asphalt recycling conveyor system comprising:

a laterally extending, horizontally disposed, collecting trough having a semicircular bottom, a front wall, a back wall and end walls;

a collecting trough hopper secured to said bottom of said collecting trough at one end thereof;

an auger having a shaft rotatably mounted in said collecting trough;

said auger having a thread directed to move asphalt in said collecting trough toward said collecting trough hopper;

a drive operably connected to said auger for rotation thereof;

a plurality of heating lines substantially coextensive with said collecting trough in heat transfer relationship with said bottom of said collecting trough;

a layer of thermal insulation on said bottom of said collecting trough;

a protective cover over said layer of thermal insulation;

a back deflecting plate upwardly extending from said back wall;

end deflecting plates upwardly extending from said end walls; and spaced guard rails extending across said collecting trough, whereby partially cooled asphalt can be deposited in said trough through said guard rails from a dump truck and caused to pass through said collection hopper for recycling.

2. An asphalt recycling conveyor system in accordance with claim 1 further including:

protruding asphalt lump breaking rods circumferentially and axially spaced on said auger shaft above said collection hopper.

3. An asphalt recycling conveyor system in accordance with claim 1 wherein:

said auger in said collection trough has a standard pitch.

4. An asphalt recycling conveyor system in accordance with claim 1 further including:

an elevating trough having longitudinally extending side walls, a semicircular bottom, and end walls;

said elevating trough having one end disposed below said collecting trough hopper and a second end disposed at a higher elevation than said collecting trough;

an elevating trough hopper secured to said bottom of said elevating trough at said second end;

an auger having a shaft rotatably mounted in said elevating trough;

said auger having a thread directed to move asphalt in said elevating trough up said elevating trough to said elevating trough hopper;

a drive operably connected to said auger in said elevating trough for rotation thereof;

a cover extending over said elevating trough.

5. An asphalt recycling conveyor system in accordance with claim 4 wherein:

said cover is foraminous.

6. An asphalt recycling conveyor system in accordance with claim 4 wherein:

said auger in said elevating trough has a thread of one half standard pitch.

7. An asphalt recycling conveyor system in accordance with claim 6 said auger in said collecting trough turns at a first speed and said auger in said elevating trough turns at a second, higher speed.

8. An asphalt recycling conveyor system in accordance with claim 4 further including:

a plurality of heating lines substantially coextensive with said elevating trough in heat transfer relationship with said bottom of said elevating trough;

a layer of thermal insulation on said bottom of said elevating trough.

9. An asphalt recycling conveyor system comprising:

a first, laterally extending, horizontally disposed, trough having a bottom;

a first hopper secured to said bottom of said first trough at one end thereof;

a first auger rotatably mounted in said first trough;

said first auger having a thread directed to move asphalt in said first trough toward said first hopper;

a first drive operably connected to said first auger for rotation thereof;

a plurality of guard rails extending across said first trough spaced sufficiently to readily permit the passage of partially cooled asphalt, while close enough to prevent personnel from passing into said first trough;

a second, inclined, trough having a bottom and a low end positioned below said first hopper;

a second auger rotatably mounted in said second trough;

said second auger having a thread directed to move asphalt from said low end to said high end;

a second drive operably connected to said second auger for rotation thereof;

a second hopper secured to said bottom of said second trough at said high end thereof;

a cover extending over said second trough, and heat trace lines on said bottoms of said first and second troughs.

10. An asphalt recycling conveyor system in accordance with claim 9 wherein:

said first auger has a shaft and a plurality of asphalt lump breaking rods extend from said shaft, circumferentially and axially spaced and located above said first hopper.

11. An asphalt recycling conveyor system in accordance with claim 9 wherein:

said first auger has a standard pitch;

said second auger has a one-half standard pitch.

* * * * *